US006123255A

United States Patent [19]

Chimera

[11] Patent Number: 6,123,255

[45] Date of Patent: Sep. 26, 2000

[54] Z-FOLD PRESSURE SEAL WITH SIDE OPENING ENVELOPE

[75] Inventor: Joseph T Chimera, Newtown, Pa.

[73] Assignee: Moore U.S.A. Inc., Grand Island, N.Y.

[21] Appl. No.: 09/137,332

[22] Filed: Aug. 20, 1998

[51] Int. Cl.[7] ..... B65D 27/06

[52] U.S. Cl. ..... 229/305; 229/306

[58] Field of Search ..... 229/305, 306

[56] References Cited

U.S. PATENT DOCUMENTS

| | | | |
|---|---|---|---|
| 4,928,875 | 5/1990 | Hutchinson . | |
| 5,169,061 | 12/1992 | Buescher | 229/305 |
| 5,174,493 | 12/1992 | File . | |
| 5,193,850 | 3/1993 | Lombardo . | |
| 5,289,972 | 3/1994 | Sauerwine et al. . | |
| 5,307,989 | 5/1994 | Dyer . | |
| 5,402,934 | 4/1995 | Sauerwine . | |
| 5,513,795 | 5/1996 | Sauerwine . | |

FOREIGN PATENT DOCUMENTS

| | | | |
|---|---|---|---|
| 29907 | of 1913 | United Kingdom | 229/305 |

OTHER PUBLICATIONS

Brochure entitled "The SpeediSealer® Pressure Seal System: Now, A Mailing System That Increases Your Profitability As Effectively As This One Reduces It", © 1995 Moore.

*Primary Examiner*—Jes F. Pascua
*Attorney, Agent, or Firm*—Nixon & Vanderhye P.C.

[57] ABSTRACT

A Z-folded mailer type business form is constructed so as to provide a maximum reply envelope area, and to allow the reply envelope to be readily opened by an automatic envelope opener, while allowing the outgoing and reply address to be easily variably imaged by a single pass through a printer and without requiring the use of removable labels.

30 Claims, 6 Drawing Sheets

Z-FOLD PRESSURE SEAL WITH SIDE OPENING ENVELOPE

BACKGROUND AND SUMMARY OF THE INVENTION

Mailer type business forms, such as shown in U.S. Pat. Nos. 5,289,972 and 5,513,795, particularly those made from a single sheet of paper, are becoming increasingly more popular. As they become widely used, there is a need to find alternative constructions to suit particular needs, and to refine the construction so as to facilitate their production and use. For example, compared to the single sheet Z-fold mailer shown in U.S. Pat. No. 5,289,972, it is desirable to be able to provide a Z-fold label with a reply envelope having a larger size to allow a larger remittance piece to be returned. It is also desirable to provide a reply envelope that is adapted to be opened by automated envelope openers, and to variably image the outgoing address, and preferably at the same time imaging the reply address or any personalized information necessary, with a single pass through a simplex printer (e.g. laser printer) and without the need for removable labels to cover up the outgoing address on the reply envelope (which is often required by postal service regulations), as known per se from U.S. Pat. No. 5,513,795.

According to the present invention, a mailer type business form intermediate is provided which produces a mailer with a larger reply envelope than antecedent forms, allows opening of the reply envelope by automated envelope openers of a standard construction, allows variable imaging using a simplex printer of outgoing address and other information, and/or does not require the use of labels to cover up the outgoing address indicia on the reply envelope.

According to one aspect of the present invention a mailer type business form intermediate is provided comprising the following components: A substantially quadrate sheet of paper having top, bottom, and first and second side edges, and first and second faces. First and second substantially parallel lines of weakness adjacent, but spaced from and substantially parallel to, the side edges to define first and second edge strips. First and second fold lines extending substantially parallel to each other and the top and bottom edges, defining the sheet of paper into (at least) first, second, and third panels, at least the first and second panels being substantially equal size, the first panel between the top edge and the first fold line, the second panel between the first and second fold lines, and the third panel between the second fold line and the bottom edge. First adhesive or cohesive patterns disposed in the edge strips to hold the panels in a Z-fold configuration when Z-folded about the first and second fold lines. Second adhesive or cohesive patterns disposed on first face of at least one of the first and second panels for forming the first and second panels into a reply envelope having an insertion opening adjacent the first line of weakness, upon Z-folding of the sheet about the fold lines. A reply envelope flap outside the area encompassed by the second adhesive or cohesive patterns, and flap sealing adhesive disposed on the first face at the flap. And the reply envelope having a height substantially equal to the extent of either of the first and second panels parallel to the side edges.

The intermediate also typically comprises only one of tacking or no adhesive or cohesive provided along or adjacent the first fold line on the first face, so that a reply envelope formed by Z-folding the sheet may be readily opened by an automated envelope opener. Outgoing address indicia is preferably imaged on the first panel second face and is upright when the top edge is at the top of the sheet.

Reply address indicia is also preferably imaged on the second panel second face and is upright when the top edge is at the top of the sheet. In order to avoid the use of labels for covering up the outgoing address on the reply envelope, etc., the intermediate also further preferably comprises a third line of weakness substantially parallel to the side edges and closer to the first side edge than the second side edge, the third line of weakness defining the reply envelope flap and defining a tear off stub or strip. Preferably, the third line of weakness passes through the outgoing address indicia, and the reply envelope flap is formed in the second panel, and the tear off strip is formed in the first panel: The reply address indicia preferably is on the opposite side of the third line of weakness from the first side edge. The third line of weakness is positioned with respect to the first side edge so that when the sheet is Z-folded about the first and second fold lines, and the edge strips and the tear off strip are removed, the reply envelope flap substantially completely covers what is left of the outgoing address indicia after removal of the tear off strip.

While the first and second adhesive or cohesive patterns may utilize any suitable type of adhesive (such as heat activated or pressure sensitive or rewettable (adhesive), or cohesive, preferably they comprise pressure activated cohesive, such as shown in U.S. Pat. Nos. 4,918,128, 5,190,818, 5,314,944, or 5,427,851. The flap adhesive preferably comprises rewettable adhesive, or pressure sensitive adhesive covered by a release strip. The sheet is preferably dimensioned so that the top and bottom edges have a length of about 8–9 inches, and the side edges have a length of about 12–15 inches, preferred constructions being legal size sheets (e.g. 8½ inches by 13 or 14 inches), although A4 paper also being possible.

Preferably the third panel is substantially the same size as the first and second panels, and the intermediate further comprises only one of tacking or no adhesive or cohesive on the second face adjacent or along one or both of the bottom edge on the first fold line on the second panel, to make the third panel easy to detach from the rest of the intermediate once received by the outgoing addressee of the mailer form intermediate. Other panels may also be provided after the first panel (so that the bottom edge comprises a fold line), with associated adhesive or cohesive to hold the components together.

The intermediate according to the invention also comprises a number of permutations of the above recited structure, including where the feature of only one of tacking or no adhesive or cohesive provided along or adjacent the first fold line on the first face so that a reply envelope formed by Z-folding the sheet may be readily opened by an ordinary envelope opener, and/or the particular configuration of the third line of weakness and the reply envelope flap, which allow the outgoing address indicia to be partially removed, and the remainder covered, in the normal use of the reply envelope (as known per se from U.S. Pat. No. 5,513,795), as characterizing features.

Also, the invention relates to a mailer type business form made from an intermediate as described above, formed by Z-folding a sheet of paper about the first and second fold lines and sealing the first and second panels of adhesive or cohesive, so that the second face of the first panel forms the front of the mailer type business and the first face of the third panel forms the rear of the mailer type business form.

It is the primary object of the present invention to provide a highly advantageous intermediate for a mailer type business form, and a mailer made by Z-folding the mailer type business form intermediate. This and other objects of the invention will become clear from an inspection of the detailed description of the invention and from the appended claims.

DETAILED DESCRIPTION OF THE DRAWINGS

Figure 1:
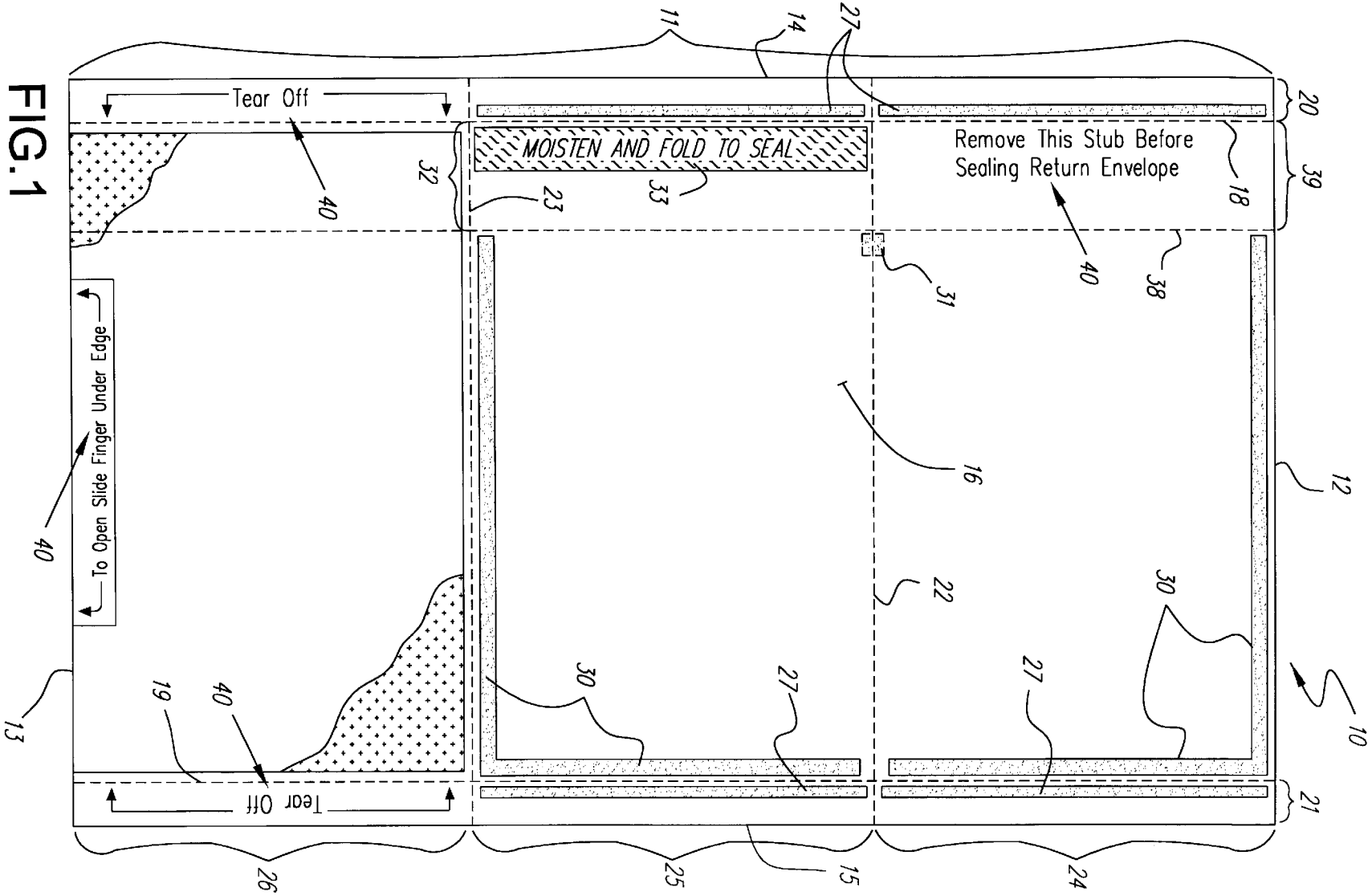
FIG. 1 is a top schematic plan view of an exemplary intermediate for a mailer type business form, according to the present invention.
Figure 2:
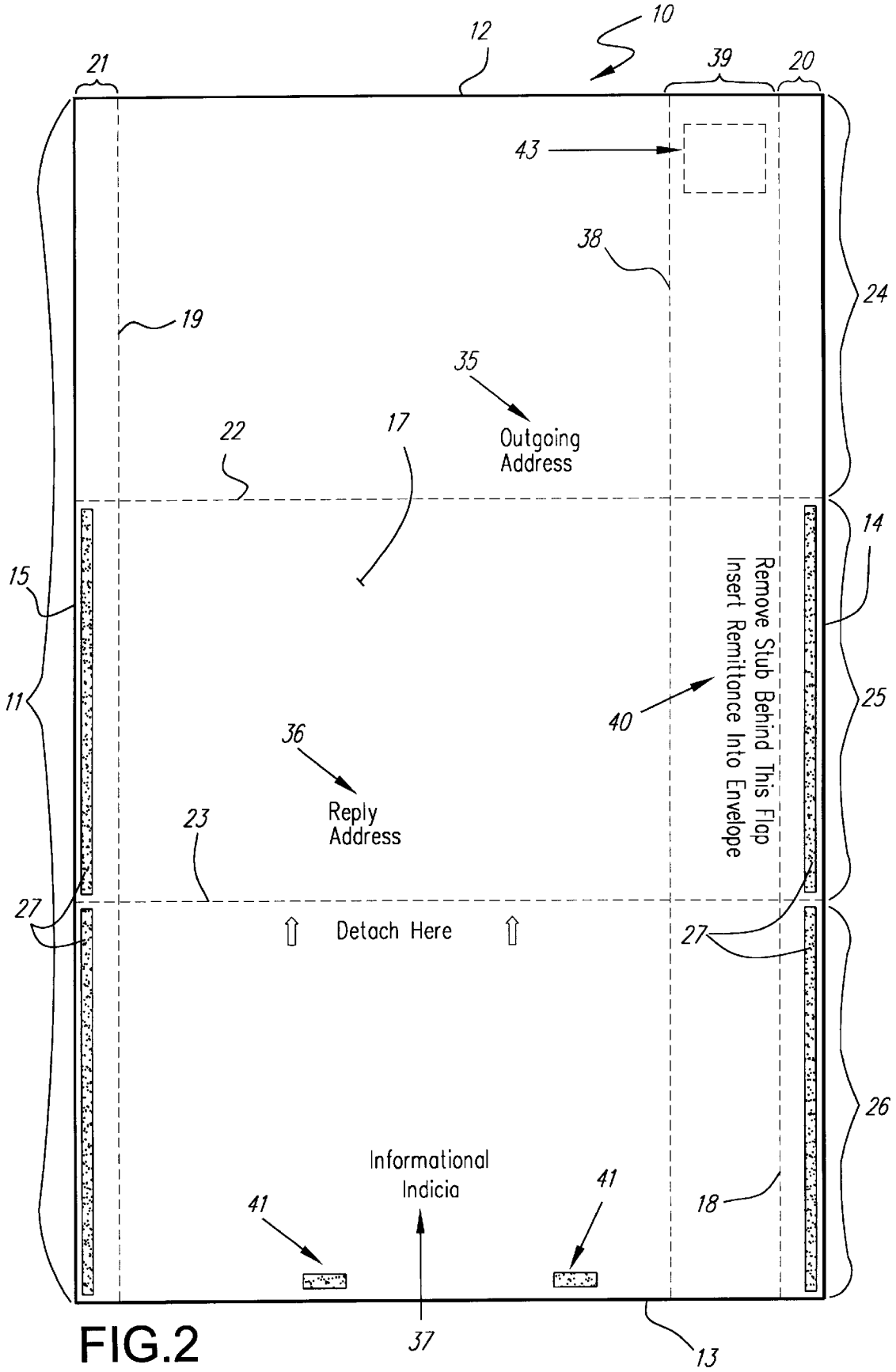
FIG. 2 is a bottom schematic plan view of the intermediate of FIG. 1.

A mailer type business form intermediate according to the present invention is shown generally by reference numeral 10 in FIGS. 1 and 2. The intermediate 10 comprises a substantially quadrate sheet of paper 11 having top 12, bottom 13, first side 14, and second side 15 edges, and first 16 (FIG. 1) and second 17 (FIG. 2) faces. The top and bottom edges 12 and 13 are substantially parallel to each other and substantially perpendicular to the side edges 14, 15 (which are substantially parallel to each other). The orientations "top", "bottom" and "side" are used for convenience only and do not limit the intermediate 10, or a mailer formed therefrom to any particular orientation. The sheet 11 is preferably dimensioned so that the top and bottom edges 12, 13 have a length of about 8–9 inches, and the side edges 14, 15 have a length of about 12–15 inches, preferred constructions being legal size sheets (e.g. 8½ inches by 13 or 14 inches), although A4 paper also being possible.

The intermediate 10 further comprises first and second substantially parallel lines of weakness 18, 19, respectively, substantially parallel to and adjacent but spaced from side edges 14, 15 to define first and second edge strips 20, 21. The lines of weakness 18, 19 may be any conventional type of line of weakness, such as perforations, die cuts, score lines, etc.

The intermediate 10 further comprises first and second fold lines 22, 23 substantially parallel to each other and the top and bottom edges 12, 13. The fold lines 22, 23 (which may be lines of weakness too) define the sheet of paper 11 into first, second, and third panels 24, 25, 26, respectively, the first panel 24 between the top edge 12 and the first fold line 22, the second panel 25 between the first fold line 22 and the second fold line 23, and the third panel 26 between the second fold line 23 and the bottom edge 13. At least the panels 24, 25 are substantially equal in size, and preferably the panel 26 is also substantially in equal in size to the panels 24, 25. However, the panel 26 may extend a lesser distance along the side edges 14, 15 than do the panels 24, 25 (which provides a special type of Z-folded mailer, namely an eccentric Z-folded mailer). Additional panels may also be connected to panel 26 so that bottom edge 12 becomes a fold line.

The intermediate 10 further comprises first adhesive or cohesive patterns, all shown in the form of strips with reference numeral 27 in FIGS. 1 and 2, disposed in the edge strips 20, 21 to hold the panels 24–26 in a Z-folded configuration when Z-folded about the fold lines 22, 23. In the embodiment actually illustrated in the drawings the strips 27 are of pressure activated cohesive, such as shown in U.S. Pat. Nos. 4,918,128, 5,190,818, 5,314,944, or 5,427,851. However, pressure sensitive adhesive, rewettable adhesive, heat activated adhesive, or any other suitable type of conventional adhesive, may alternatively be utilized. Also, the patterns need not be continuous strips as illustrated at 27 in FIGS. 1 and 2, but may have other configurations, such as closely spaced dots or other patterns. Also, where adhesive is used instead of cohesive it is not necessary to put patterns in both adjoining panels, but rather to hold the panels 24, 25 together when Z-folded the adhesive need only be provided on the edge strips of one of the panels 24, 25, and similarly with respect to the panels 25, 26.

Figure 4:
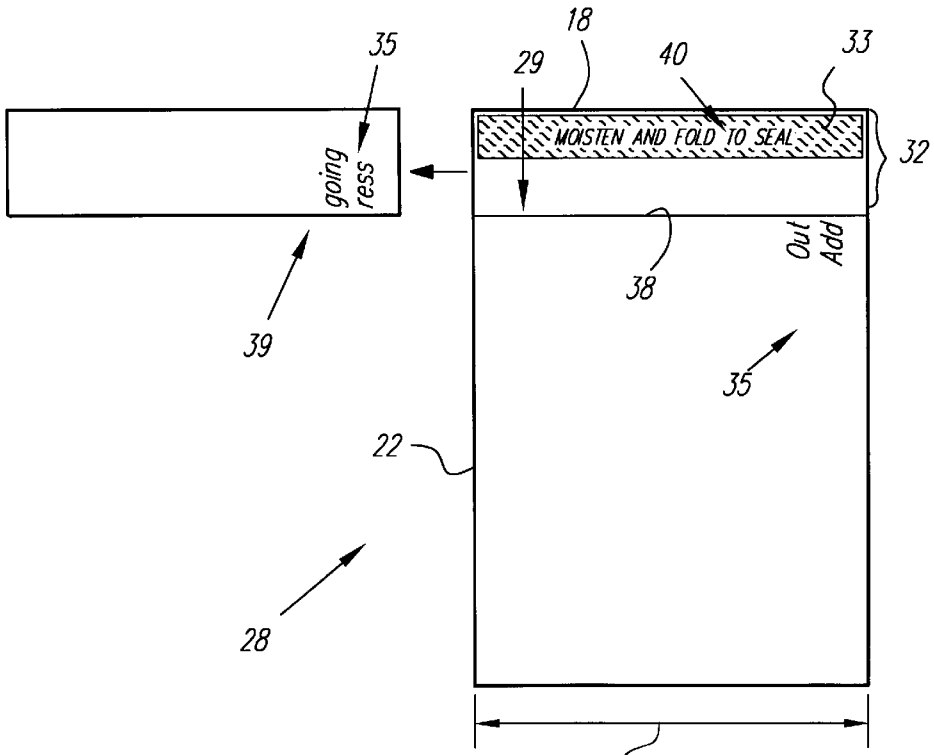
FIG. 4 is a rear view of the reply envelope from the mailer of FIG. 3 before sealing, and showing the tear-off stub removed therefrom.
Figure 5:
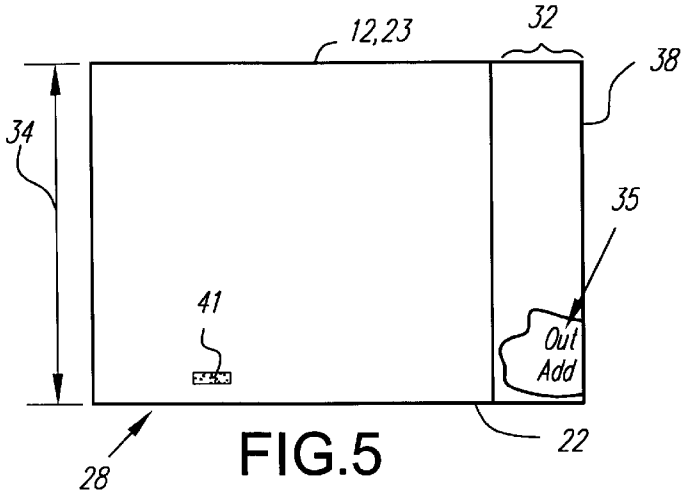
FIG. 5 is a view like that of FIG. 4 only after the reply envelope has been sealed, with the flap cut away to shown underlying structure.
Figure 6:
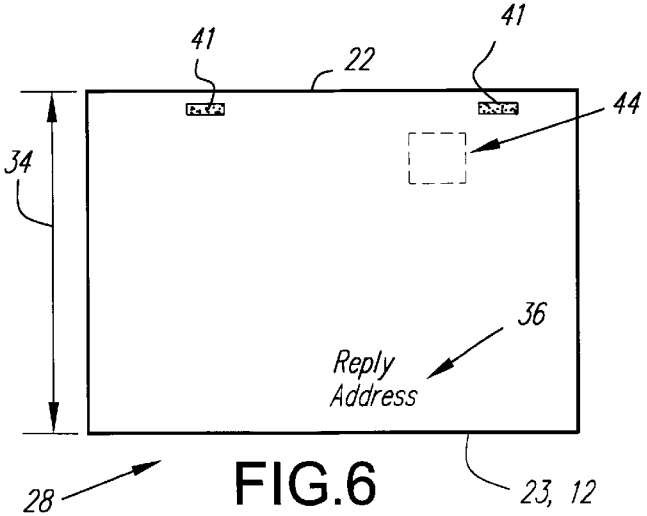
FIG. 6 is a front view of the sealed reply envelope of FIG. 5.

The intermediate 10 also comprises second adhesive or cohesive patterns disposed on the first face 16 of at least one of the first and second panels 24, 25, in forming the first and second panels 24, 25 into a reply envelope—illustrated schematically at 28 in FIGS. 4 through 6—having an insertion opening 29 (see FIG. 4) adjacent the first line of weakness 18 upon Z-folding of the sheet 11, particularly about the first fold line 22. In the exemplary embodiment illustrated in FIG. 1, the second adhesive or cohesive patterns comprise the generally L-shaped patterns 30 of pressure sensitive cohesive (as described in the exemplary embodiment above for the strips 27) which are on both the panels 24, 25 and which cooperate with each other when the sheet 11 is folded about the fold line 22. However, in the preferred embodiment of the invention, along the fold line 22 (which will be the "top" of the reply envelope 28—see FIGS. 5 and 6) there is only one of tacking or no adhesive or cohesive. In the embodiment illustrated a simple tack 31 of pressure sensitive cohesive is provided at one point along the fold line 22 (on opposite sides thereof). Again, the patterns 30, and the tack 31, may be other types of adhesive such as rewettable, heat activated, etc. rather than pressure sensitive cohesive.

The simple tack 31 (more than one tacking dot or pattern may be provided along the edge 22, but preferably only one tack or pattern is used if any at all), or no adhesive at all, is utilized in order to facilitate opening of the reply envelope 28 using conventional automated envelope opening equipment. It is for this reason too that the patterns 30 adjacent the second line of weakness 19 stop short of the fold line 22. The fact that a hinge is provided in the paper at the fold line 22 provides sufficient integrity to the reply envelope 28 so that significant amounts of adhesive or cohesive are not needed along the fold line 22.

The intermediate 10 also comprises a reply envelope flap 32 (see FIGS. 1 and 4 in particular) outside the area encompassed by the patterns 30 and flap sealing adhesive 33 is disposed on the first face 16 of the flap 32. Preferably, the flap sealing adhesive 33 is rewettable adhesive, although it may also comprise a pressure sensitive adhesive covered by a release strip, or the like.

Because of the construction of the intermediate 10, being substantially devoid of other lines of weakness or fold lines parallel to the edges 12, 13, the reply envelope 28 has a height—indicated at 34 in FIGS. 4 through 6—substantially equal to the extent of the first and second panels 24, 25 parallel to the side edges 14, 15. This provides a relatively large (for the size of the sheet 11) remittance or other insert pocket in the reply envelope 28, accessible through the opening 29, compared to some prior art constructions.

The intermediate 10 is passed in either sheet or continuous (i.e. the edges 12, 13 connected to like intermediate 10, defining lines of weakness) form through a printer or like imaging device to provide variable indicia thereon and/or non-variable indicia. At some point outgoing address indicia 35 (see FIGS. 2, 3 and 4 in particular) is provided on the second face 17 of the first panel. The indicia 35 is upright when the top edge 12 is at the top of the sheet 11. Also, reply address indicia 36 is also imaged on the second face 17, this time in the second panel 25, again upright when the edge 12 is at the top of the sheet 11. Other variable or non-variable indicia imaged at the same time as the address 35, such as the informational indicia 37 on the third panel 26, is also imaged at the same time, and has the same orientation, that is the printer may readily simplex print all of the indicia 35–37.

The intermediate 10 also preferably comprises a third line of weakness 38 substantially parallel to the side edges 14, 15 and closer to the side edge 14 than the second side edge 15. The third line of weakness 38 (which may comprise a perforation line) defines the reply envelope flap 32, as well as defining a tear-off stub 39 (see FIGS. 1, 2, and 4). As most clearly seen in FIGS. 2 and 4, the third line of weakness 38 passes through the outgoing address indicia 35 and defines the reply envelope flap 32 in the second panel 25 and the tear-off stub in the first panel 24. Preferably the reply address 36 is on the opposite side of the line 38 from the first side edge 14, as also seen in FIG. 2.

As can be seen primarily from FIGS. 2, 4, and 5, the third line of weakness 38 is positioned with respect to the first edge 14 and the outgoing address indicia 35 so that when the sheet 11 is Z-folded about the fold lines 22, 23 and the edge strips 20, 21 and the tear-off stub 39 are removed, the reply envelope flap 32 is folded over to substantially completely cover what is left of the outgoing address indicia after removal of the tear-off strip. That is, removing the tear-off strip 39 removes the right half of the outgoing address indicia 35 as viewed in FIG. 2, and folding over the flap 32 at the line of weakness 38 to the position illustrated in FIG. 5 covers what remains of the outgoing address indicia 35 so that that indicia is not visible on the reply envelope 28.

The intermediate 10 also preferably has a significant amount of instructional indicia that is preprinted (that is, before utilizing any printer to print the variable indicia 35 or the like) on the intermediate 10, when the paper sheet 11 is initially handled (e.g. adhesive or cohesive applied, perforation or fold lines introduced, etc.). This instructional preprinted indicia is shown at various locations in FIGS. 1 and 2 and at reference numeral 40.

Figure 3:
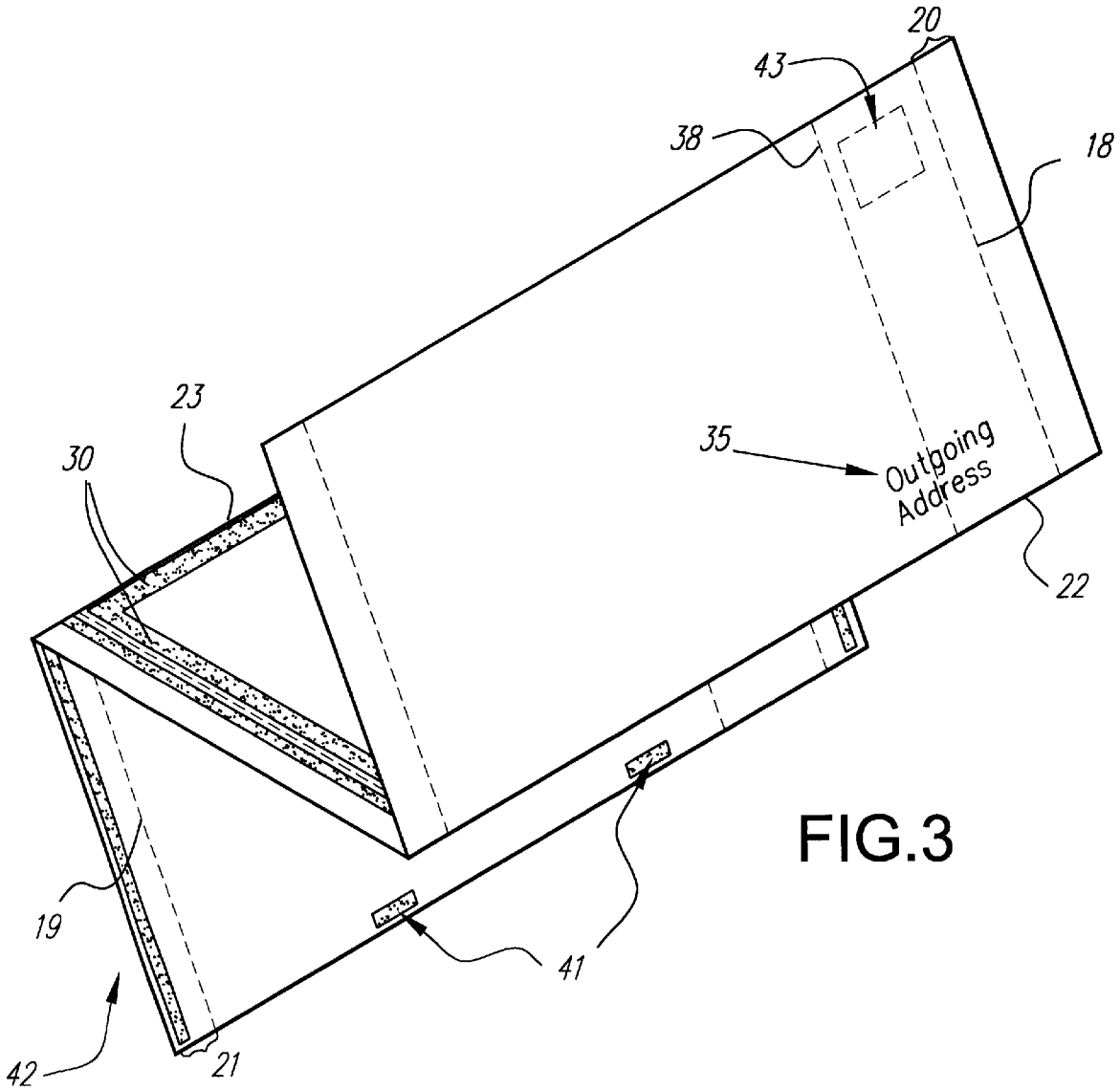
FIG. 3 is a top perspective view showing Z-folding of the intermediate of FIGS. 1 and 2 to form a mailer type business form according to the invention.

The intermediate 10 also may include tacking adhesive or cohesive, such as shown by the widely spaced rectangle of pressure activated cohesive 41 primarily in FIGS. 1 and 3, on the second face 17 adjacent or along one or both of the bottom edge 13 and the first fold line 22 in the second panel 25. This tacking adhesive or cohesive 41 merely gently assists in holding the mailer—shown generally at 42 in FIG. 3—together when the sheet 11 is Z-folded about the fold lines 22, 23, but is readily removed by the addressee of the mailer 42 and does not significantly tear the sheet 11 when the mailer 42 is opened. FIG. 3 shows the Z-folding operation which ultimately produces the mailer 42. After Z-folding as indicated at FIG. 3, which is preferably accomplished by conventional automatic equipment, the mailer 42 is passed through appropriate sealing equipment, the equipment used depending upon the nature of the adhesive or cohesive pattern or tacks 27, 30, 31, 41. For example, where those patterns or tacks are pressure sensitive cohesive, the mailer 42 is passed through conventional pressure application equipment such as available from Moore U.S.A., Inc. of Lake Forest, Ill. under the mark "SPEEDISEALER". In the mailer 42, the second face 17 of the first panel 24 forms the front of the mailer 42, and the first face 16 of the third panel 26 forms the rear.

Figure 7:
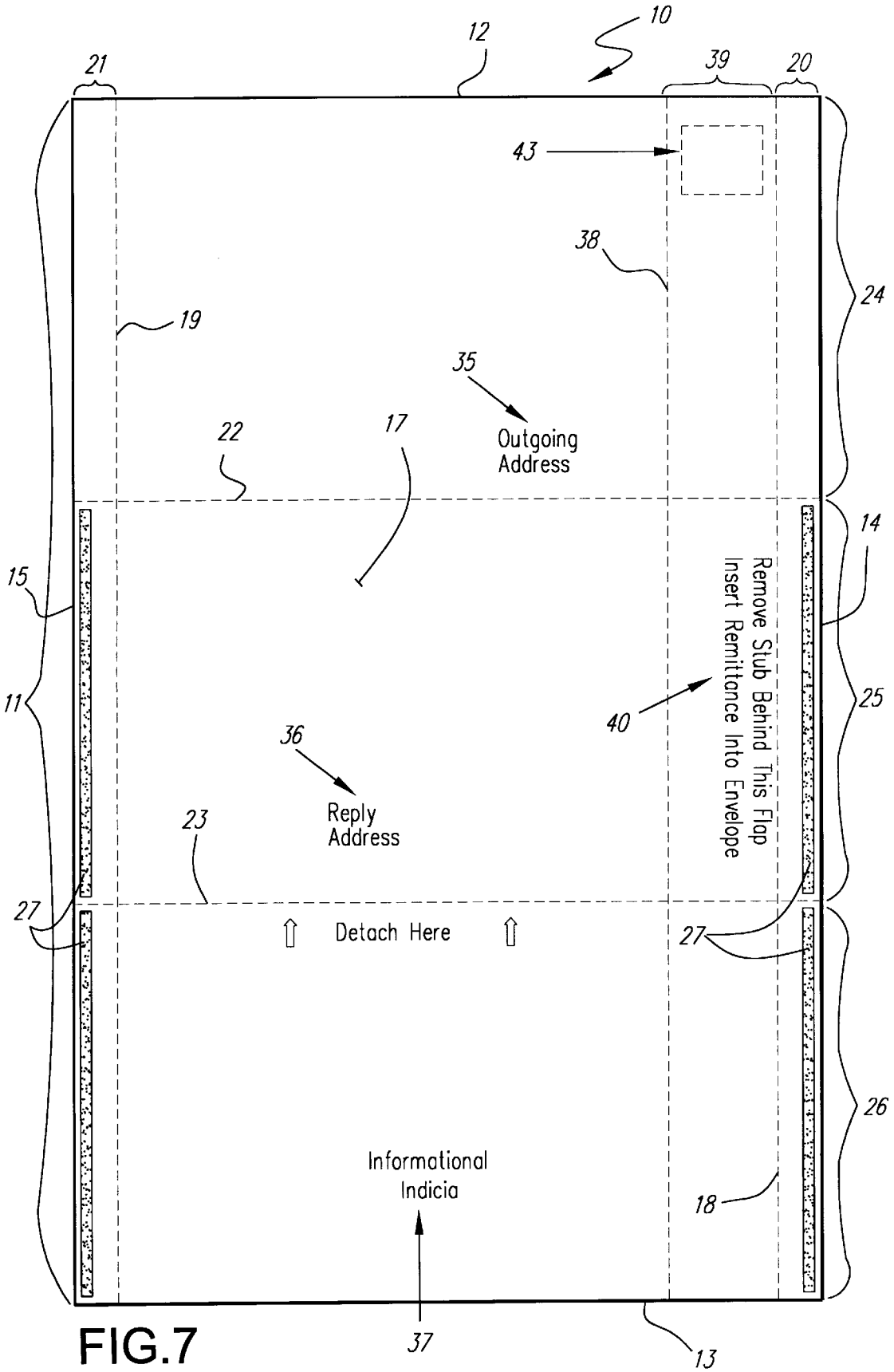
FIG. 7 is a view like that of FIG. 2 only of another embodiment according to the invention.

FIG. 7 shows an embodiment the same as FIG. 2 only without the tacking adhesive elements 41. That is no adhesive is provided for connecting the panels 25, 26 together along the edge 13 and fold line 22 thereof.

Figure 8:
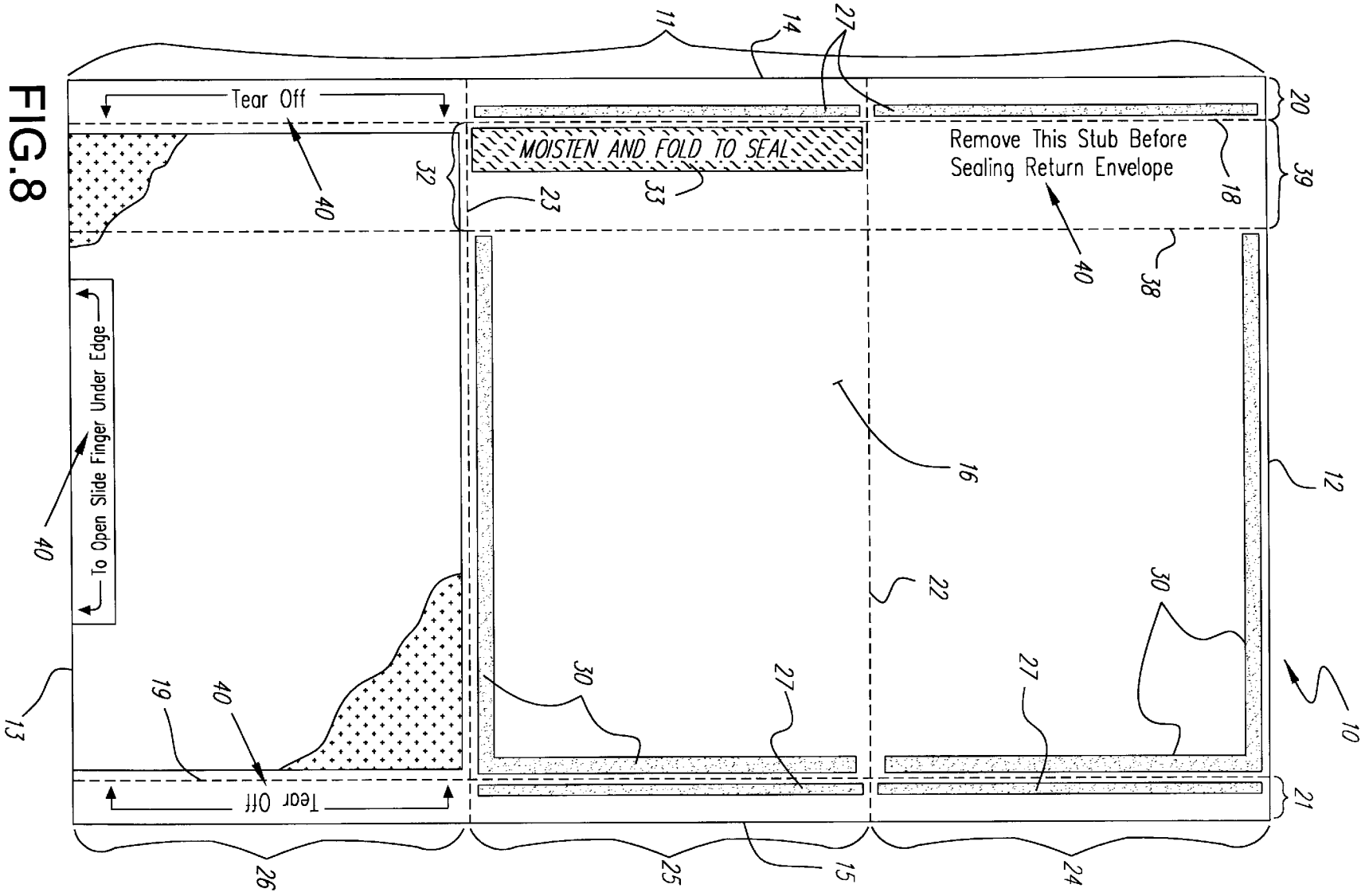
FIG. 8 is a view like that of FIG. 1 only of another embodiment according to the invention.

FIG. 8 shows an embodiment the same as FIG. 1 only without the adhesive 31. That is no adhesive is provided on the first face 16 along or adjacent the first fold line 22, so that the reply envelope formed by Z-folding the sheet may be readily opened by an automated envelope opener.

Once the mailer 42 has been constructed and postage applied, postage typically being applied in the tear-off stub 39 above the outgoing address indicia 35 as seen in FIGS. 2 and 3 (the postage schematically illustrated at 43), the recipient of the mailer 42, following the instructions provided by the indicia 40, removes the edge strips 20, 21 by tearing along the lines of weakness 18, 19, separates the third panel 26 from the first and second panels 24, 25 at the tack adhesive or cohesive 41 (if provided), and then removes the tear-off stub 39 by tearing at the third line of weakness 38. Another appropriate stub or coupon, if provided, such as the stub or coupon between the lines 18, 23, 38 and the edge 13 in the third panel 26 (if the third line of weakness extends into that panel 26) may have indicia thereon providing a remittance stub or the like. Alternatively, other information may also be utilized or other documents provided, such as a check or money order. Then the mailer 42 recipient inserts a stub, and/or a check, and/or whatever documents are appropriate, into the reply envelope 28 through the open end 29 thereof, then folds the reply envelope flap 32 about the line 38 and moistens or otherwise activates the adhesive 33 so as to seal the flap 32 to the back of the reply envelope 28, as seen in FIG. 5, covering up what remains of the outgoing address 35. Then postage is applied—as illustrated schematically at 44 in FIG. 6—to the front of the reply envelope 28. The reply envelope 28 is then mailed to the reply address 36, and once received at the reply address may easily be opened up utilizing automated envelope opening equipment because either no adhesive or cohesive, or only a tack such as the tack 31 seen in FIG. 1, is provided at the fold line 22, which forms the top edge of the reply envelope 28.

It will thus be seen that according to the present invention a highly advantageous intermediate for a mailer type business form, and a mailer type business produced from the intermediate, have been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and products.

What is claimed is:

1. A mailer type business form intermediate, comprising:

a substantially quadrate sheet of paper having top, bottom, and first and second side edges, and first and second faces;

first and second substantially parallel lines of weakness adjacent, but spaced from and substantially parallel to, said side edges to define first and second edge strips;

first and second fold lines extending substantially parallel to each other and said top and bottom edges, defining said sheet of paper into at least first, second, and third panels, at least said first and second panels being substantially equal size, said first panel between said top edge and said first fold line, said second panel between said first and second fold lines, and said third panel between said second fold line and said bottom edge;

first adhesive patterns disposed in said edge strips to hold said panels in a Z-fold configuration when Z-folded about said first and second fold lines;

second adhesive patterns disposed on said first face of at least one of said first and second panels for forming said first and second panels into a reply envelope having an insertion opening adjacent said first line of weakness, upon Z-folding of said sheet about said fold lines;

a reply envelope flap comprising part of one of said first, second or third panels, and outside the area encompassed by said second adhesive patterns, and flap sealing adhesive disposed on said first face at said flap;

said reply envelope having a height substantially equal to the extent of either of said first and second panels parallel to said side edges; tacking adhesive provided along or adjacent said first fold line on said first face, so that a reply envelope formed by Z-folding said sheet may be readily opened by an automated envelope opener.

2. An intermediate as recited in claim 1 further comprising outgoing address indicia imaged on said first panel second face and is upright when said top edge is at the top of said sheet.

3. An intermediate as recited in claim 2 further comprising reply address indicia imaged on said second panel second face and is upright when said top edge is at the top of said sheet.

4. An intermediate as recited in claim 3 further comprising a third line of weakness substantially parallel to said side edges and closer to said first side edge than said second side edge, said third line of weakness defining said reply envelope flap and defining a tear off strip.

5. An intermediate as recited in claim 4 wherein said third line of weakness passes through said outgoing address indicia, and wherein said reply envelope flap is formed in said second panel and said tear off stub is formed in said first panel; and wherein said reply address indicia is on the opposite side of said third line of weakness from said first side edge.

6. An intermediate as recited in claim 5 wherein said third line of weakness is positioned with respect to said first side edge so that when said sheet is Z-folded about said first and second fold lines, and said edge strips and said tear off stub are removed, said reply envelope flap substantially completely covers what is left of said outgoing address indicia after removal of said tear off stub.

7. An intermediate as recited in claim 6 wherein said first and second adhesive patterns comprise pressure activated cohesive.

8. An intermediate as recited in claim 6 wherein said sheet is dimensioned so that said top and bottom edges have a length of about 8–9 inches, and said side edges have a length of about 12–15 inches.

9. A mailer type business form made from the intermediate as recited in claim 6 formed by Z-folding said sheet of paper about said first and second fold lines and sealing said first and second patterns of adhesive, and so that said second face of said first panel forms the front of said mailer type business form and said first face of said third panel forms the rear of said mailer type business form.

10. An intermediate as recited in claim 1 further comprising outgoing address indicia imaged on said first panel second face and upright when said top edge is at the top of said sheet and reply address indicia imaged on said second panel second face and upright when said top edge is at the top of said sheet.

11. An intermediate as recited in claim 10 further comprising a third line of weakness substantially parallel to said side edges and closer to said first side edge than said second side edge, said third line of weakness defining said reply envelope flap and defining a tear off stub, said third line of weakness passing through said outgoing address indicia; and wherein said reply envelope flap is formed in said second panel and said tear off stub is formed in said first panel; and wherein said reply address indicia is on the opposite side of said third line of weakness from said first side edge.

12. An intermediate as recited in claim 11 wherein said third line of weakness is positioned with respect to said first side edge so that when said sheet is Z-folded about said first and second fold lines, and said edge strips and said tear off stub are removed, said reply envelope flap substantially completely covers what is left of said outgoing address indicia after removal of said tear off stub.

13. A mailer type business form made from the intermediate as recited in claim 1 formed by Z-folding said sheet of paper about said first and second fold lines and sealing said first and second patterns of adhesive, and so that said second face of said first panel forms the front of said mailer type business form and said first face of said third panel forms the rear of said mailer type business form.

14. A mailer type business form intermediate, comprising:

a substantially quadrate sheet of paper having top, bottom, and first and second side edges, and first and second faces;

first and second substantially parallel lines of weakness adjacent, but spaced from and substantially parallel to, said side edges to define first and second edge strips;

first and second fold lines extending substantially parallel to each other and said top and bottom edges, defining said sheet of paper into at least first, second, and third panels, at least said first and second panels being substantially equal size, said first panel between said top edge and said first fold line, said second panel between said first and second fold lines, and said third panel between said second fold line and said bottom edge;

first adhesive patterns disposed in said edge strips to hold said panels in a Z-fold configuration when Z-folded about said first and second fold lines;

second adhesive patterns disposed on first face of at least one of said first and second panels for forming said first and second panels into a reply envelope having an insertion opening adjacent said first line of weakness, upon Z-folding of said sheet about said fold lines;

a reply envelope flap comprising part of one of said first, second or third panels, and outside the area encompassed by said second adhesive patterns and flap sealing adhesive disposed on said first face at said flap; and tacking adhesive provided along or adjacent said first fold line on said first face, so that a reply envelope formed by Z-folding said sheet may be readily opened by an automated envelope opener.

15. An intermediate as recited in claim 14 further comprising outgoing address indicia imaged on said first panel second face and upright when said top edge is at the top of said sheet and reply address indicia imaged on said second panel second face and upright when said top edge is at the top of said sheet.

16. An intermediate as recited in claim 15 further comprising a third line of weakness substantially parallel to said side edges and closer to said first side edge than said second side edge, said third line of weakness defining said reply envelope flap and defining a tear off stub, said third line of weakness passing through said outgoing address indicia; and wherein said reply envelope flap is formed in said second panel and said tear off stub is formed in said first panel; and wherein said reply address indicia is on the opposite side of said third line of weakness from said first side edge.

17. An intermediate as recited in claim 16 wherein said third line of weakness is positioned with respect to said first side edge so that when said sheet is Z-folded about said first and second fold lines, and said edge strips and said tear off stub are removed, said reply envelope flap substantially completely covers what is left of said outgoing address indicia after removal of said tear off stub.

18. An intermediate as recited in claim 14 further comprising tacking adhesive on said second face adjacent or along one or both of said bottom edge and said first fold line in said second panel, and wherein said third panel is substantially the same size as said first and second panels.

19. A mailer type business form made from the intermediate as recited in claim 14 formed by Z-folding said sheet of paper about said first and second fold lines and sealing said first and second patterns of adhesive, and so that said second face of said first panel forms the front of said mailer type business form and said first face of said third panel forms the rear of said mailer type business form.

20. An intermediate as recited in claim 14 further comprising no adhesive on said second face adjacent or along one or both of said bottom edge and said fold line and said second panel, and wherein said third panel is substantially the same size as said first and second panels.

21. A mailer type business form intermediate, comprising:

a substantially quadrate sheet of paper having top, bottom, and first and second side edges, and first and second faces;

first and second substantially parallel lines of weakness adjacent, but spaced from and substantially parallel to, said side edges to define first and second edge strips;

first and second fold lines extending substantially parallel to each other and said top and bottom edges, defining said sheet of paper into at least first, second, and third panels, at least said first and second panels being substantially equal size, said first panel between said top edge and said first fold line, said second panel between said first and second fold lines, and said third panel between said second fold line and said bottom edge;

first adhesive patterns disposed in said edge strips to hold said panels in a Z-fold configuration when Z-folded about said first and second fold lines;

second adhesive patterns disposed on first face of at least one of said first and second panels for forming said first and second panels into a reply envelope having an insertion opening adjacent said first line of weakness, upon Z-folding of said sheet about said fold lines;

a reply envelope flap comprising part of one of said first, second or third panels, and outside the area encompassed by said second adhesive patterns and flap sealing adhesive disposed on said first face at said flap; and no adhesive provided along or adjacent said first fold line on said first face, so that a reply envelope formed by Z-folding said sheet may be readily opened by an automated envelope opener.

22. An intermediate as recited in claim 21 further comprising outgoing address indicia imaged on said first panel second face and upright when said top edge is at the top of said sheet and reply address indicia imaged on said second panel second face and upright when said top edge is at the top of said sheet.

23. An intermediate as recited in claim 22 further comprising a third line of weakness substantially parallel to said side edges and closer to said first side edge than said second side edge, said third line of weakness defining said reply envelope flap and defining a tear off stub, said third line of weakness passing through said outgoing address indicia; and wherein said reply envelope flap is formed in said second panel and said tear off stub is formed in said first panel; and wherein said reply address indicia is on the opposite side of said third line of weakness from said first side edge.

24. An intermediate as recited in claim 23 wherein said third line of weakness is positioned with respect to said first side edge so that when said sheet is Z-folded about said first and second fold lines, and said edge strips and said tear off stub are removed, said reply envelope flap substantially completely covers what is left of said outgoing address indicia after removal of said tear off stub.

25. An intermediate as recited in claim 21 further comprising no adhesive on said second face adjacent or along one or both of said bottom edge and said fold line and said second panel, and wherein said third panel is substantially the same size as said first and second panels.

26. A mailer type business form intermediate, comprising:

a substantially quadrate sheet of paper having top, bottom, and first and second side edges, and first and second faces;

first and second substantially parallel lines of weakness adjacent, but spaced from and substantially parallel to, said side edges to define first and second edge strips;

first and second fold lines extending substantially parallel to each other and said top and bottom edges, defining said sheet of paper into at least first, second, and third panels, at least said first and second panels being substantially equal size, said first panel between said top edge and said first fold line, said second panel between said first and second fold lines, and said third panel between said second fold line and said bottom edge;

first adhesive patterns disposed in said edge strips to hold said panels in a Z-fold configuration when Z-folded about said first and second fold lines;

second adhesive patterns disposed on said first face of at least one of said first and second panels for forming said first and second panels into a reply envelope having an insertion opening adjacent said first line of weakness, upon Z-folding of said sheet about said fold lines;

a reply envelope flap comprising part of one of said first, second or third panels, and outside the area encompassed by said second adhesive patterns, and flap sealing adhesive disposed on said first face at said flap;

said reply envelope having a height substantially equal to the extent of either of said first and second panels parallel to said side edges; and no adhesive provided along or adjacent said first fold line, so that a reply envelope formed by Z-folding said sheet may be readily opened by an automated envelope opener.

27. An intermediate as recited in claim 26 wherein said sheet is dimensioned so that said top and bottom edges have a length of about 8–9 inches, and said side edges have a length of about 12–15 inches.

28. An intermediate as recited in claim 26 further comprising outgoing address indicia imaged on said first panel second face and upright when said top edge is at the top of said sheet and reply address indicia imaged on said second panel second face and upright when said top edge is at the top of said sheet.

29. An intermediate as recited in claim 28 further comprising a third line of weakness substantially parallel to said side edges and closer to said first side edge than said second side edge, said third line of weakness defining said reply envelope flap and defining a tear off stub, said third line of weakness passing through said outgoing address indicia; and wherein said reply envelope flap is formed in said second panel and said tear off stub is formed in said first panel; and wherein said reply address indicia is on the opposite side of said third line of weakness from said first side edge.

30. An intermediate as recited in claim 29 wherein said third line of weakness is positioned with respect to said first side edge so that when said sheet is Z-folded about said first and second fold lines, and said edge strips and said tear off stub are removed, said reply envelope flap substantially completely covers what is left of said outgoing address indicia after removal of said tear off stub.

* * * * *